US008366160B2

(12) United States Patent
Orbeta et al.

(10) Patent No.: US 8,366,160 B2
(45) Date of Patent: Feb. 5, 2013

(54) HIGH STRENGTH ELECTRIC DOOR STRIKE WITH GRAVITY FED LOCKING MEMBER

(75) Inventors: Ferdinand E. Orbeta, Mount Kisco, NY (US); William Schildwachter, Danbury, CT (US)

(73) Assignee: Trine Access Technology, Inc., Bronx, NY (US)

( * ) Notice: Subject to any disclaimer, the term of this patent is extended or adjusted under 35 U.S.C. 154(b) by 386 days.

(21) Appl. No.: 12/754,060

(22) Filed: Apr. 5, 2010

(65) Prior Publication Data

US 2011/0241361 A1 Oct. 6, 2011

(51) Int. Cl.
*E05B 15/02* (2006.01)

(52) U.S. Cl. ..... 292/341.16

(58) Field of Classification Search ..... 292/341.16
See application file for complete search history.

(56) References Cited

U.S. PATENT DOCUMENTS

| | | | | |
|---|---|---|---|---|
| 3,638,984 | A | 2/1972 | Davidson | |
| 3,749,435 | A | 7/1973 | Balzano | |
| 4,471,983 | A | 9/1984 | Bischoff et al. | |
| 4,984,835 | A | 1/1991 | Vadacchino et al. | |
| 5,127,691 | A | 7/1992 | Herron et al. | |
| 6,634,685 | B2 | 10/2003 | Herron et al. | |
| 6,935,663 | B2 * | 8/2005 | Schildwachter et al. | 292/341.16 |
| 7,185,928 | B1 * | 3/2007 | Liao | 292/341.16 |
| 7,322,621 | B2 * | 1/2008 | Liao | 292/341.16 |
| 7,562,918 | B2 * | 7/2009 | Toma et al. | 292/341.16 |
| 7,722,097 | B2 * | 5/2010 | Schnarr et al. | 292/341.16 |
| 7,900,981 | B2 * | 3/2011 | Hirschoff | 292/341.16 |
| 8,132,833 | B2 * | 3/2012 | Schnekenburger | 292/341.16 |
| 8,146,966 | B1 * | 4/2012 | Webb et al. | 292/341.15 |

* cited by examiner

*Primary Examiner* — Carlos Lugo
*Assistant Examiner* — Mark Williams
(74) *Attorney, Agent, or Firm* — Norris McLaughlin & Marcus, P.A.

(57) ABSTRACT

A high strength electrically operable door strike having a simplified design and a gravity fed locking member. The strike comprises two solenoids operating in opposite directions wherein one solenoid is used when the strike is mounted for use with a left hand opening door and the other solenoid is used when the strike is mounted for use with a right hand opening door. The strike is simply turned upside down to accommodate a door having the opposite hand. The strike has a housing which is reinforced with ribs. The ribs also provide a reduced surface area sliding surface for the gravity fed locking member and thereby permit the locking member to slide up and down with less friction.

4 Claims, 11 Drawing Sheets

HIGH STRENGTH ELECTRIC DOOR STRIKE WITH GRAVITY FED LOCKING MEMBER

FIELD OF THE INVENTION

The invention relates to an electrically operable door strike used to prevent the opening of an associated door.

BACKGROUND OF THE INVENTION

Electrically operable strikes are well known in the art and, for example, they are used frequently in connection with the main access door of an apartment building to prevent entry into the building until a solenoid associated with the strike is electrically energized to permit pivoting of the strike keeper. See, for example, U.S. Pat. Nos. 6,634,685; 5,127,691; 4,984,835; 4,471,983; 3,638,984 and 3,749,435. It is also known in the art to prevent release of the latch or keeper of the strike and opening of the door by electrically energizing the solenoid. Normally, the solenoid is energized by means of a circuit completing switch remote from the strike.

In addition, the known strikes usually require several components, such as pivotable levers, etc. which increases the assembly problems and the likelihood of malfunctioning because of misalignment, binding or corrosion.

In general, prior art strikes comprise a single solenoid which has a winding of a conductor which, when electrically energized, actuates an armature which has a locking member connected thereto and biased by a spring so that the locking member prevents pivoting of the keeper unless the solenoid is electrically energized. To keep the energizing current low, the biasing spring usually has a force which is only slightly more than the force required to return the locking member and the armature to their locking or unlocking positions. Such spring return force may, at times, such as with misalignment of parts, accumulation of foreign matter, etc., be insufficient to return them to their unlocking or locking positions.

It is also known in the art to use an air actuated piston and cylinder assembly with the piston connected to the locking member to actuate the locking member.

OBJECTS OF THE INVENTION

An object of the invention is to provide a strike construction which requires a force to break the locking member which is substantially greater than the force required to break prior art locking mechanisms.

Another object of the invention is to provide a strike which merely by inversion of the strike housing and changing the electrical connection to the strike from one end to the other, the "hand" of the strike can be changed from left hand to right hand and vice versa.

Another object of the invention is to provide a strike in which the locking member can be returned to its normal position, that is, the position which it assumes in the absence of energization of the solenoid, without a spring.

A further object of the invention is to provide a strike in which the locking member is spaced from an interior wall of the strike housing ribs which reduce friction between the locking member and the wall while increasing the strength of the housing.

SUMMARY OF THE INVENTION

The objects of the invention are attained in the preferred embodiment of the invention by pivotally mounting a keeper on a housing, such keeper having a pair of locking member engaging arms extending from the surface of the keeper perpendicular to the pivot axis. The arms engage the edges of a slidably mounted locking member when the keeper is in the locked position. Notches provided between the edges of the locking member allow the arms to disengage the edges when the keeper is unlocked and the arms then move freely through the notches when the keeper rotates on its pivot axis. In the embodiment of the invention where the strike is normally in the locked position, the keeper is urged into its locking position by a spring, and the locking member is urged into its locking position by gravity. In an alternate embodiment, where the strike is normally in the unlocked position, the keeper is urged into its locking position by a spring and the locking member is urged into its unlocking position by gravity.

The locking member bears against an internally ribbed wall of the housing so that any force applied thereto by the keeper is transmitted to the ribbed wall.

Two solenoids are mounted on the housing, one above the other, with their axes in parallel to the direction of movement of the locking member and coaxial with one another. Only one solenoid is used to actuate or move rectilinearly and upwardly vertically the locking member, namely, the solenoid in the bottom or lower position. When the strike housing is inverted to accommodate a door having the opposite hand, the other solenoid becomes the bottom solenoid and it is used to actuate or move rectilinearly and upwardly vertically the locking member. Thus, the shaft of one solenoid, when actuated, moves in the opposite direction and away from the shaft of the other. But only one solenoid is used when the strike is installed because actuation of both solenoids would prevent movement of the locking member.

The locking member has parallel and planar major surfaces and can be die cut from metal plate stock.

DETAILED DESCRIPTION OF THE PREFERRED EMBODIMENT

Figure 13:
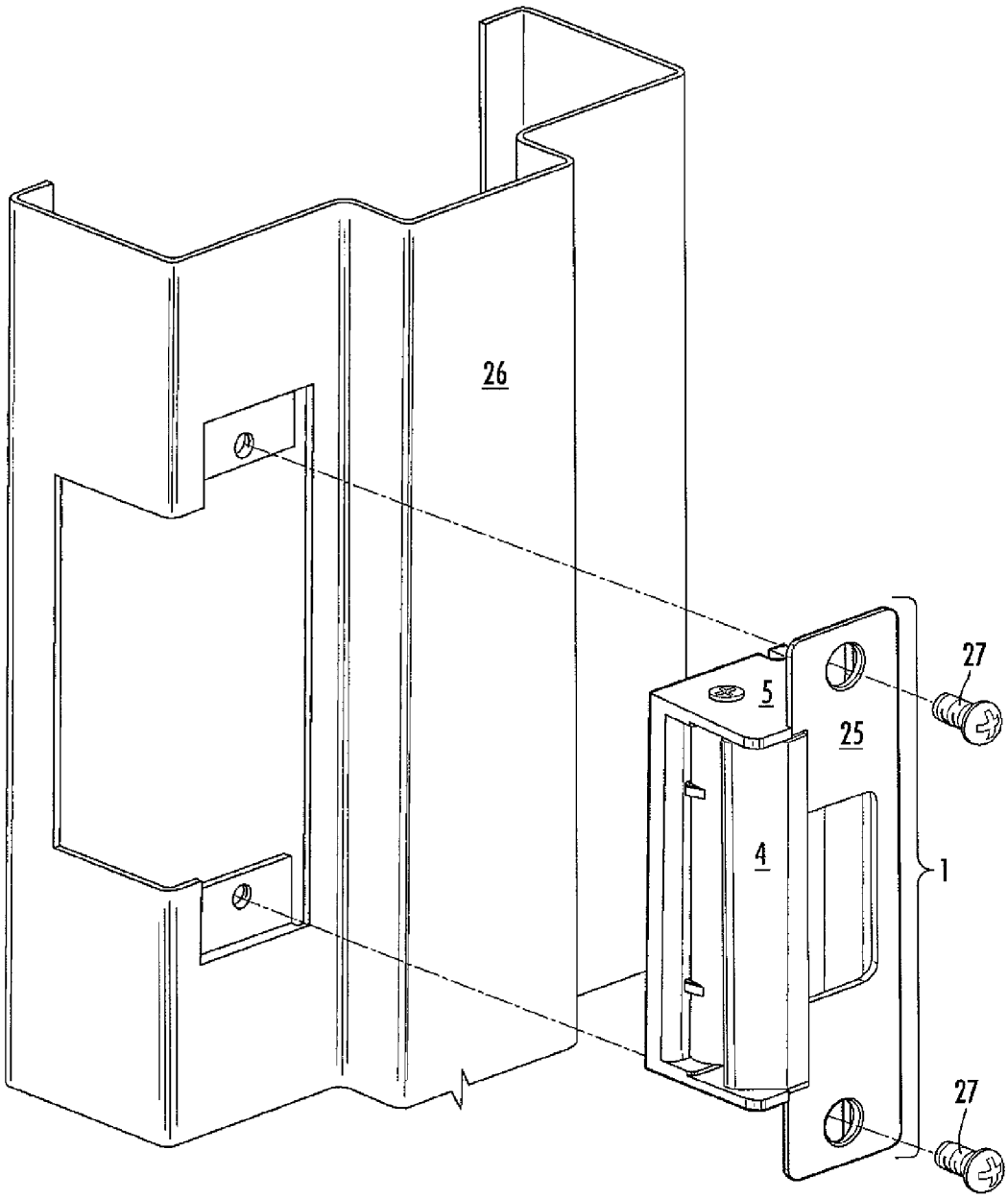
FIG. 13 is an exploded view of a partial door frame and the strike of FIG. 1.

Referring to the drawings, the strike 1 (FIG. 13) is mounted in a door frame 26 associated with a door 2 (FIG. 5) having a spring biased latch 3 engaging a keeper 4.

The keeper 4 is pivotally mounted on the housing 5 (FIG. 1) by means of a rod 6 received at one end in an opening 7 at the bottom of housing 5, passing through aperture 8 of keeper 4 and received at its opposite end in opening 9 at the top of housing 5. The rod can be secured in position with a screw 10 which is affixed in threaded opening 11 of rod 6, the keeper 4 being pivotable around the axis of rod 6. Thus, the axis of rod 6 is the pivot axis of the keeper.

The housing 5 has a rear wall 12 with plates 13 and 14 affixed thereon. Each plate comprises ribs 15 and the ribs 15 are lined up with locking member 16 which is slideably arranged between the ribs 15 and a curved face 17 at the rear of keeper 4.

Figure 1:
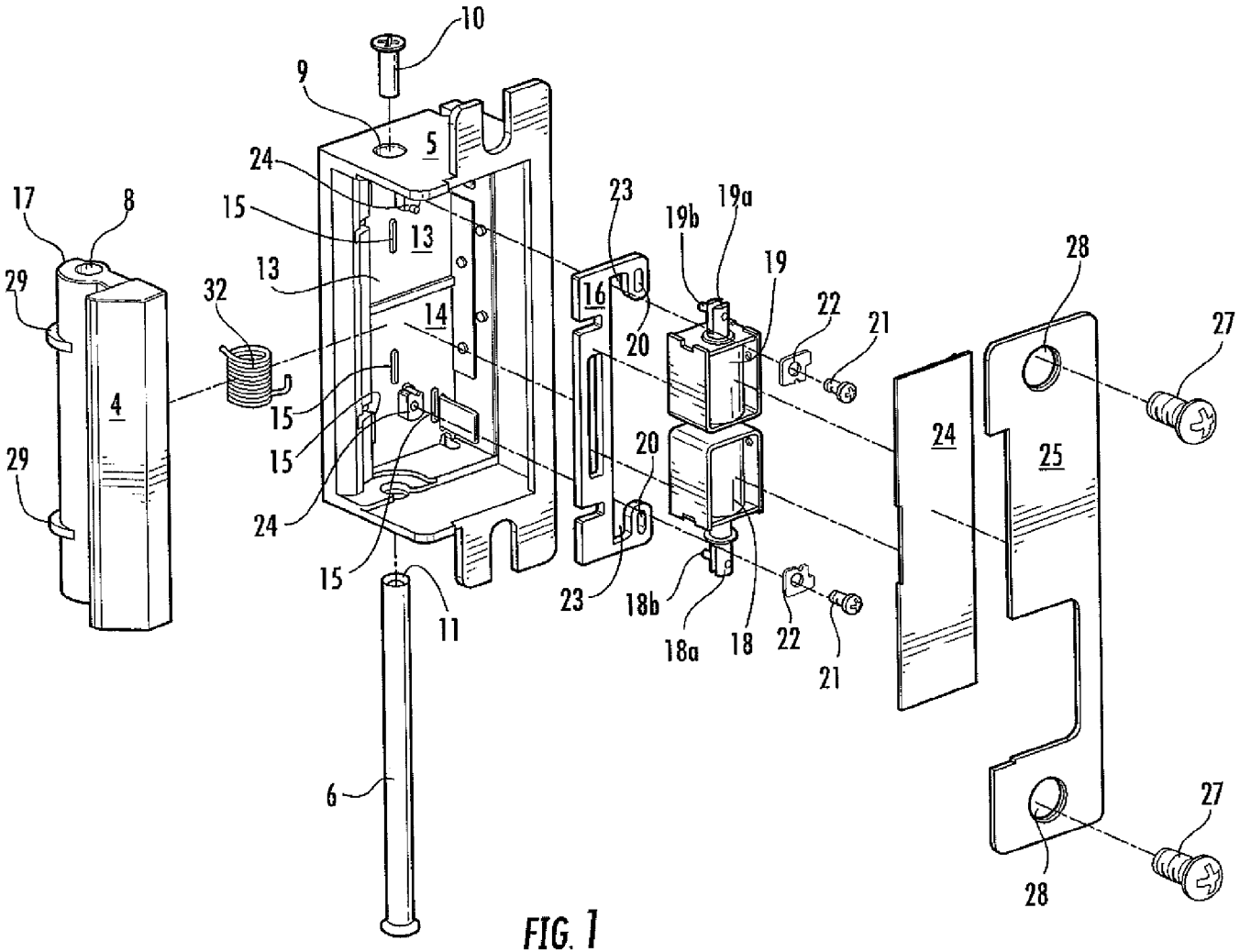
FIG. 1 is an exploded view of the strike of the invention.
Figure 3:
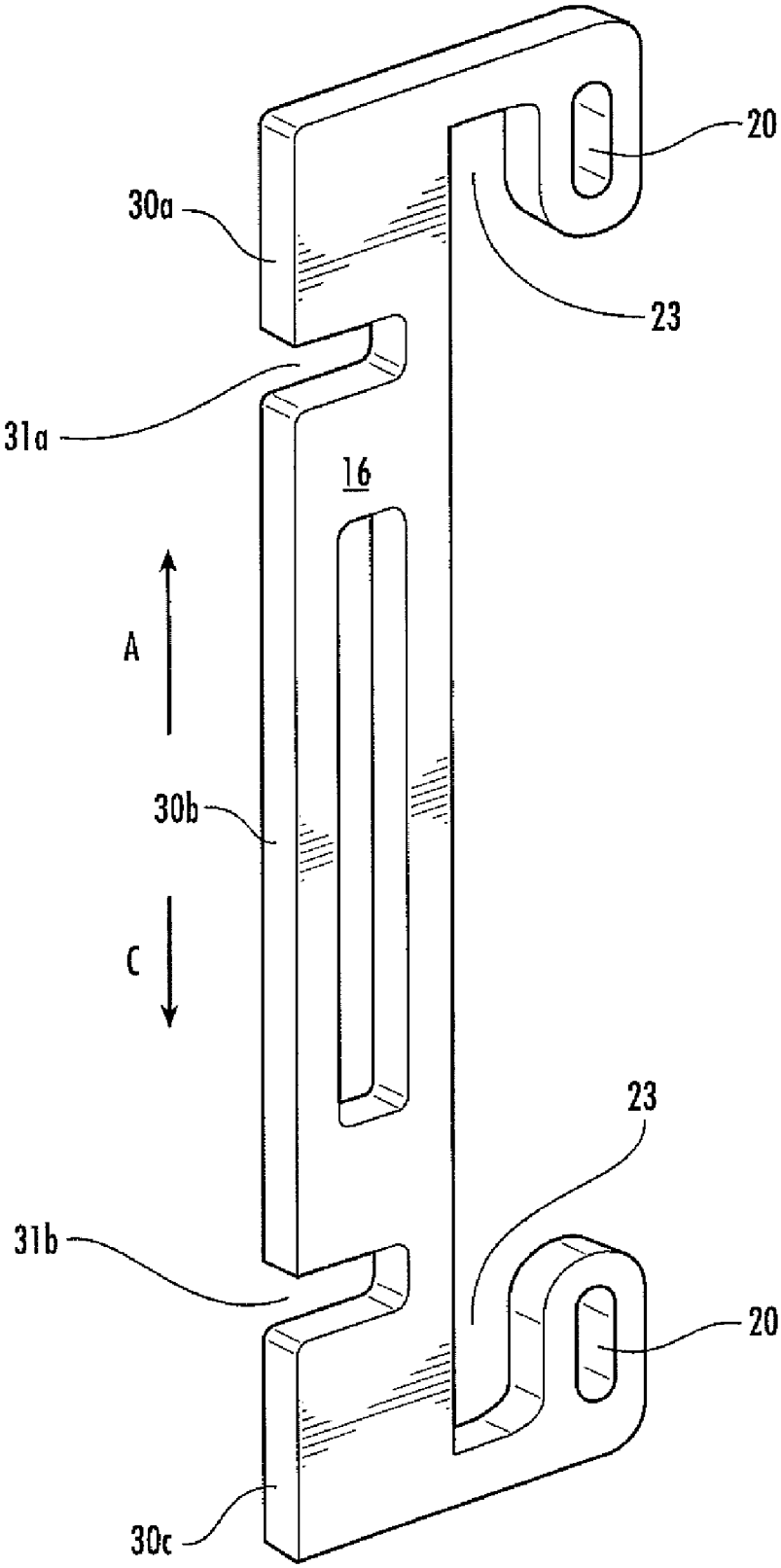
FIG. 3 is a perspective view of the slideable locking member for the embodiment where the strike is normally in the locked position.
Figure 5:
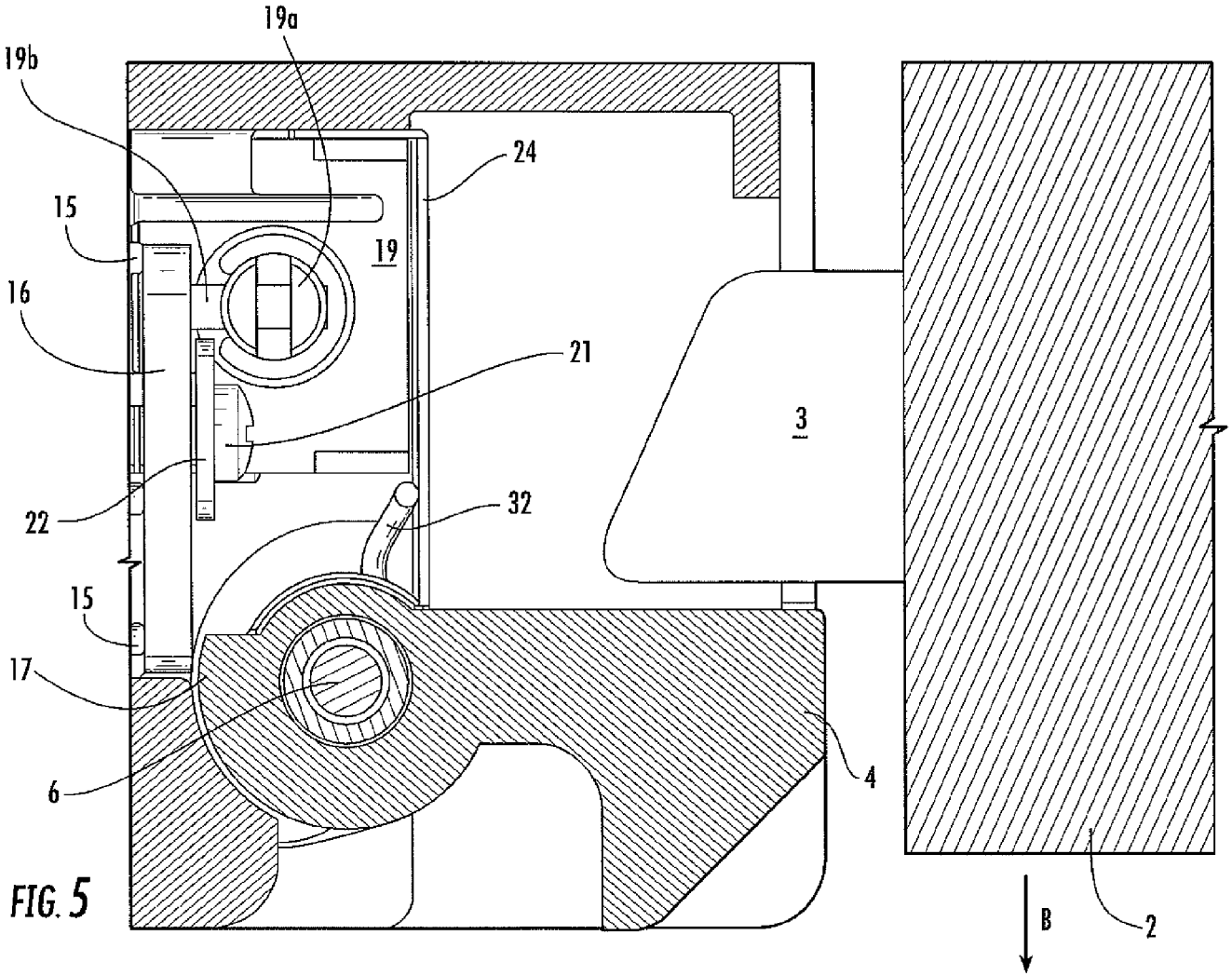
FIG. 5 is a top section view illustrating the relationship of the installed strike of FIG. 1 to a door and latch.

Solenoids 18 and 19 have respective shafts 18*a* and 19*a* and the shafts respectively have pins 18*b* and 19*b*. The pins extend into slotted openings 20 of locking member 16 (FIGS. 1, 3 and 5). Because the solenoids move in opposite directions when actuated, they provide improved security to the operation of the strike.

Alignment screws 21 extend through washers 22 and open slots 23 of locking member 16 and are threaded into raised threaded portions 24 extending from plates 13 and 14. The alignment screws 21 maintain the locking member 16 in slideable alignment with the ribs 15, the pins 18*b* and 19*b*, the curved face 17 and other elements of the preferred embodiment as explained below. Protective plate 24 is mounted within the housing and face plate 25 is affixed to a door frame 26 with mounting screws 27 which pass through openings 28.

The curved face 17 has a pair of locking arms 29 extending outwardly and perpendicularly to the pivot axis. When the keeper 4 is in the locked position, the arms 29 abut against two of edges 30 (either 30*a* and 30*b* or 30*c* and 30*b* as explained below) of locking member 16. Locking member 16 is employed when the strike 1 is normally locked and it is unlocked when the solenoid is activated.

When the strike 1 is installed in a door frame for a right hand opening door (the positions illustrated in the drawings) the arms 29 abut against edges 30*a* and 30*b* when the strike is locked. The strike is unlocked by activating solenoid 18 and causing the locking member 16 to move upwardly in the direction of arrow A allowing the arms 29 to line up with slots 31*a* and 31*b* so that the keeper 4 can rotate freely about the pivot axis when the door 2 is pulled open in the direction of arrow B. When solenoid 18 is deactivated, the keeper 4 is returned to its locked position by the action of spring 32 and locking member 16 returns to its locked position by the action of gravity.

For a left hand door installation (not shown), the strike 1 is inverted. The arms 29 abut against edges 30*c* and 30*b* when the strike is locked. The strike is unlocked by activating solenoid 19 and causing the locking member to move upwardly in the direction of arrow C (the opposite direction of arrow A because the strike has been inverted) allowing the arms 29 to line up with slots 31*a* and 31*b* so that the keeper can rotate freely about the pivot axis when the door is pulled open. When the solenoid 19 is deactivated, the keeper 4 is returned to its locked position by the action of spring 32 and locking member 16 returns to its locked position by the action of gravity.

Figure 4:
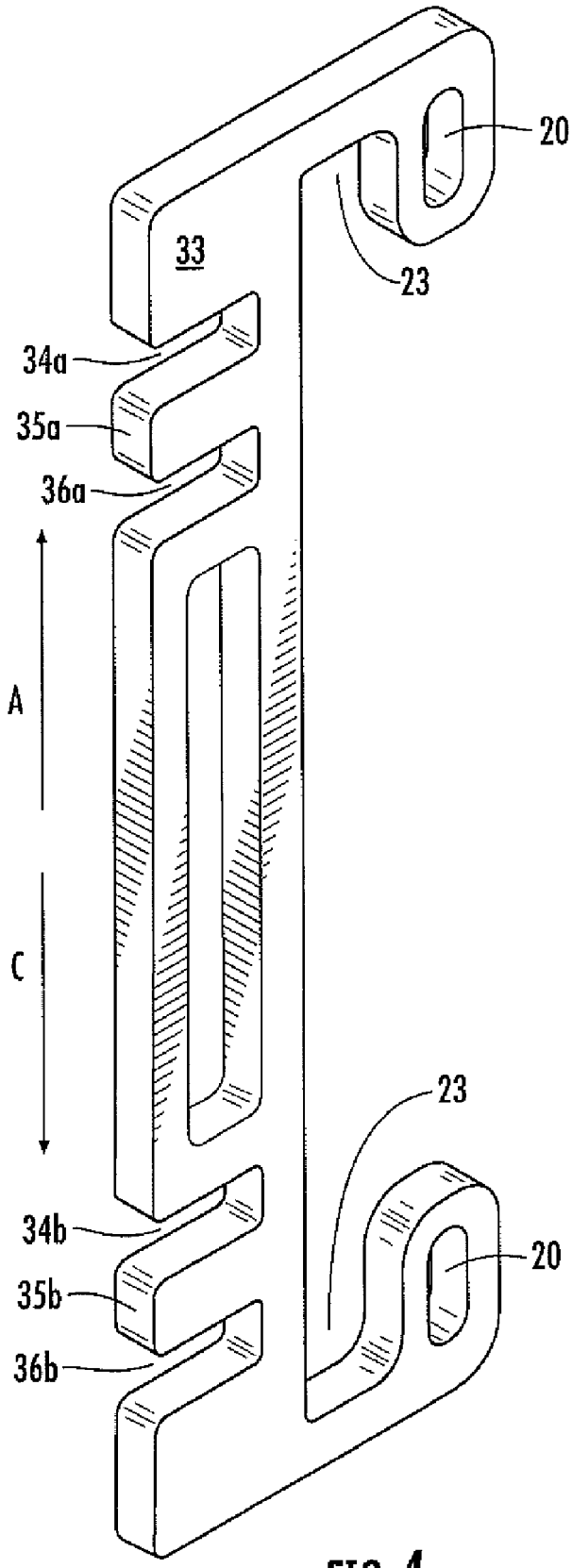
FIG. 4 is a perspective view of the slideable locking member for the embodiment where the strike is normally in the unlocked position.

When locking member 33 (see FIG. 4) is employed, the strike is normally unlocked and becomes locked when the solenoid is activated. When the strike 1 is installed in a door frame for a right hand opening door, the arms 29 line up with slots 34*a* and 34*b* so that the keeper 4 can rotate freely about the pivot axis. The strike is locked by activating solenoid 18 and causing the locking member 33 to move upwardly in the direction of arrow A causing the arms 29 to abut against edges 35*a* and 35*b*.

When the strike 1 comprising locking member 33 is installed in a door frame for a left hand opening door, the arms 29 line up with slots 36*a* and 36*b* so that the keeper 4 can rotate freely about the pivot axis. The strike is locked by activating solenoid 19 and causing the locking member 33 to move upwardly in the direction of arrow C causing the arms 29 to abut against edges 35*a* and 35*b*.

Figure 10:
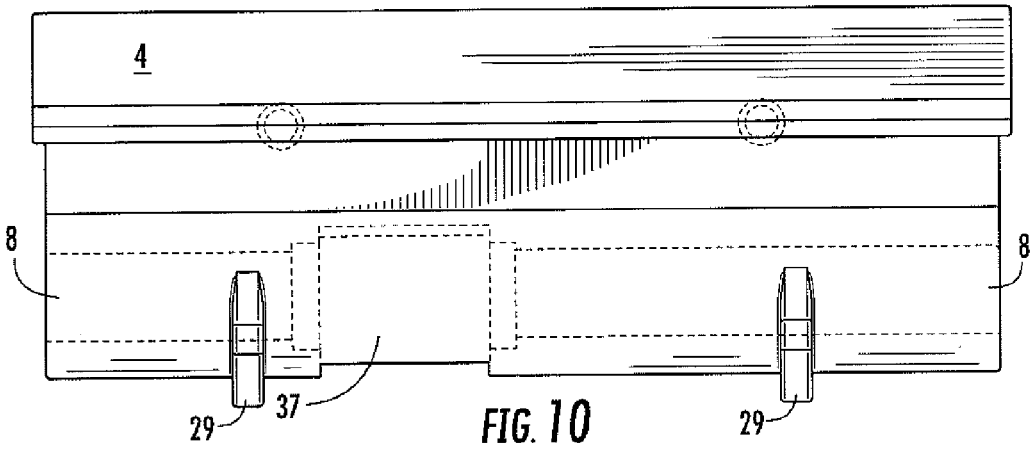
FIG. 10 is a front elevation view of the keeper.
Figure 11:
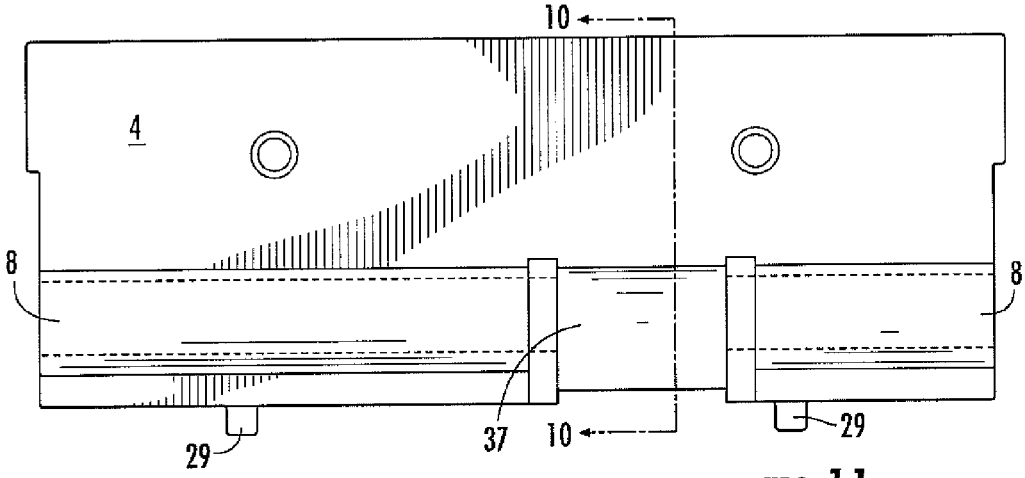
FIG. 11 is a rear elevation view of the keeper.
Figure 12:
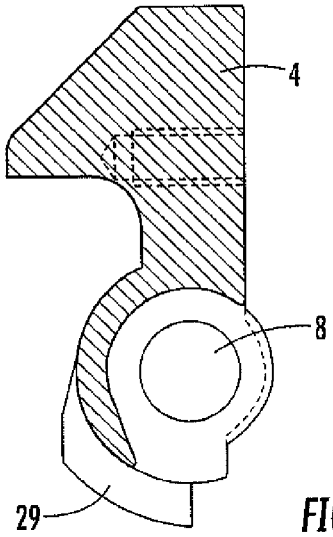
FIG. 12 is a section view of the keeper taken along section line 10-10 of FIG. 9.

FIGS. 10, 11 and 12 are provided to illustrate the keeper 4 in more detail. FIG. 10 is a front elevation view of keeper 4 illustrating with dotted lines the aperture 8 and notch 37 which interrupts aperture 8 approximately mid-way along the longitudinal length of the aperture. Notch 37 accommodates spring 32 which is illustrated in FIG. 1 and partially illustrated in FIG. 5. FIG. 11 is a rear elevation view of keeper 4 and notch 37 is visible on this side of the keeper. The section view in FIG. 12 further illustrates these features.

Figure 2:
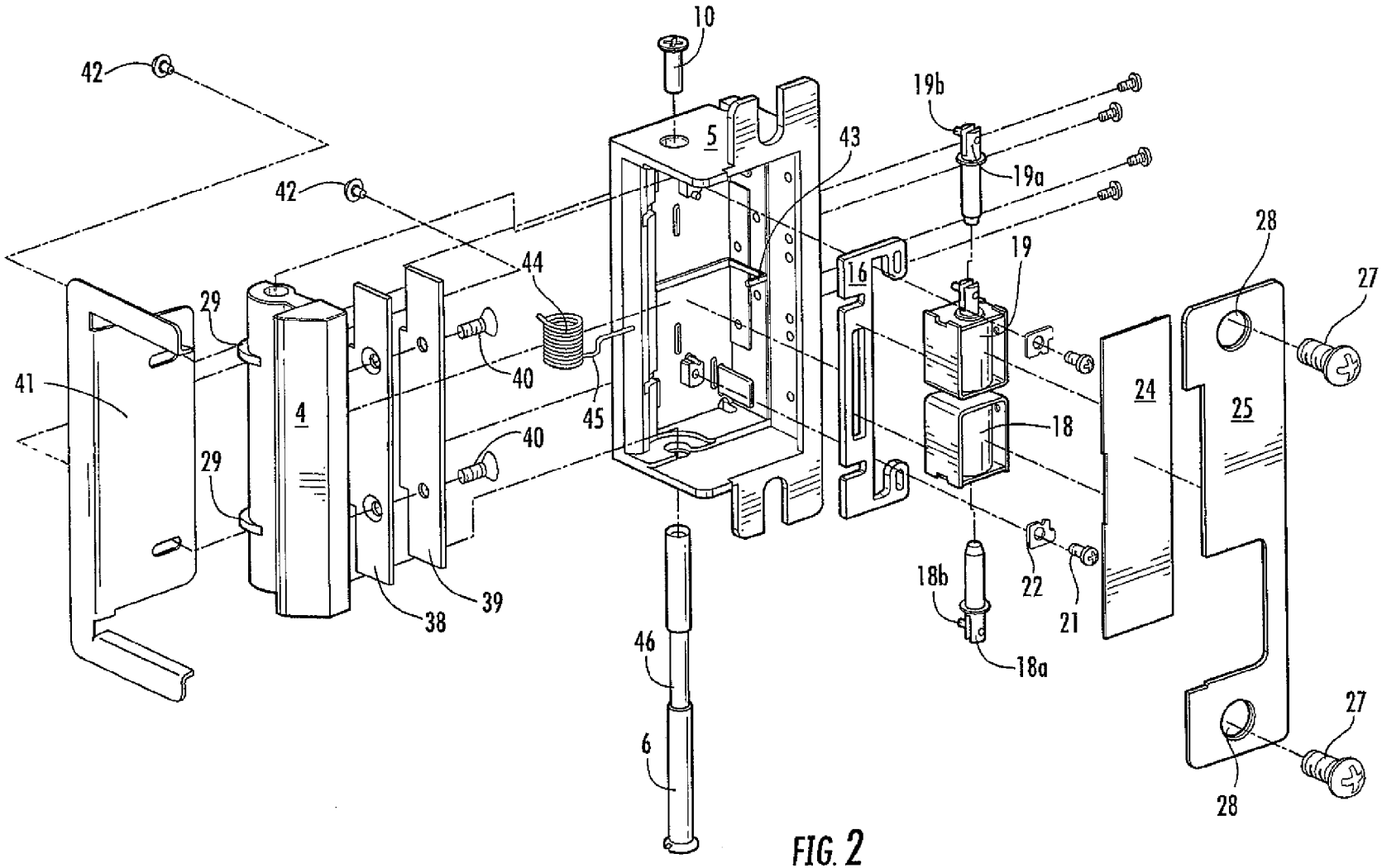
FIG. 2 is an exploded view of another embodiment of the strike of the invention.
Figure 6:
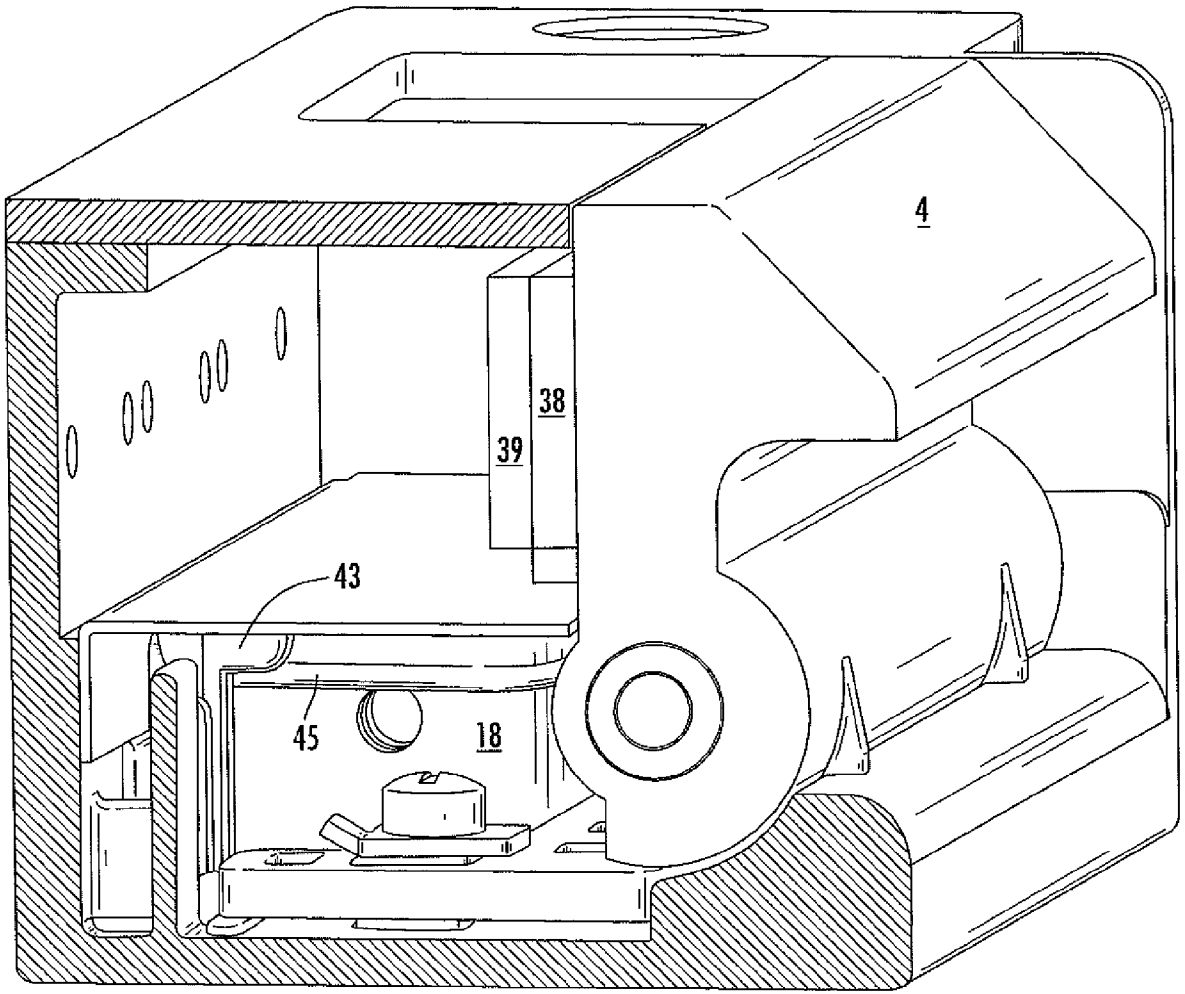
FIG. 6 is a perspective, partial section view of a partially assembled strike of FIG. 2.
Figure 7:
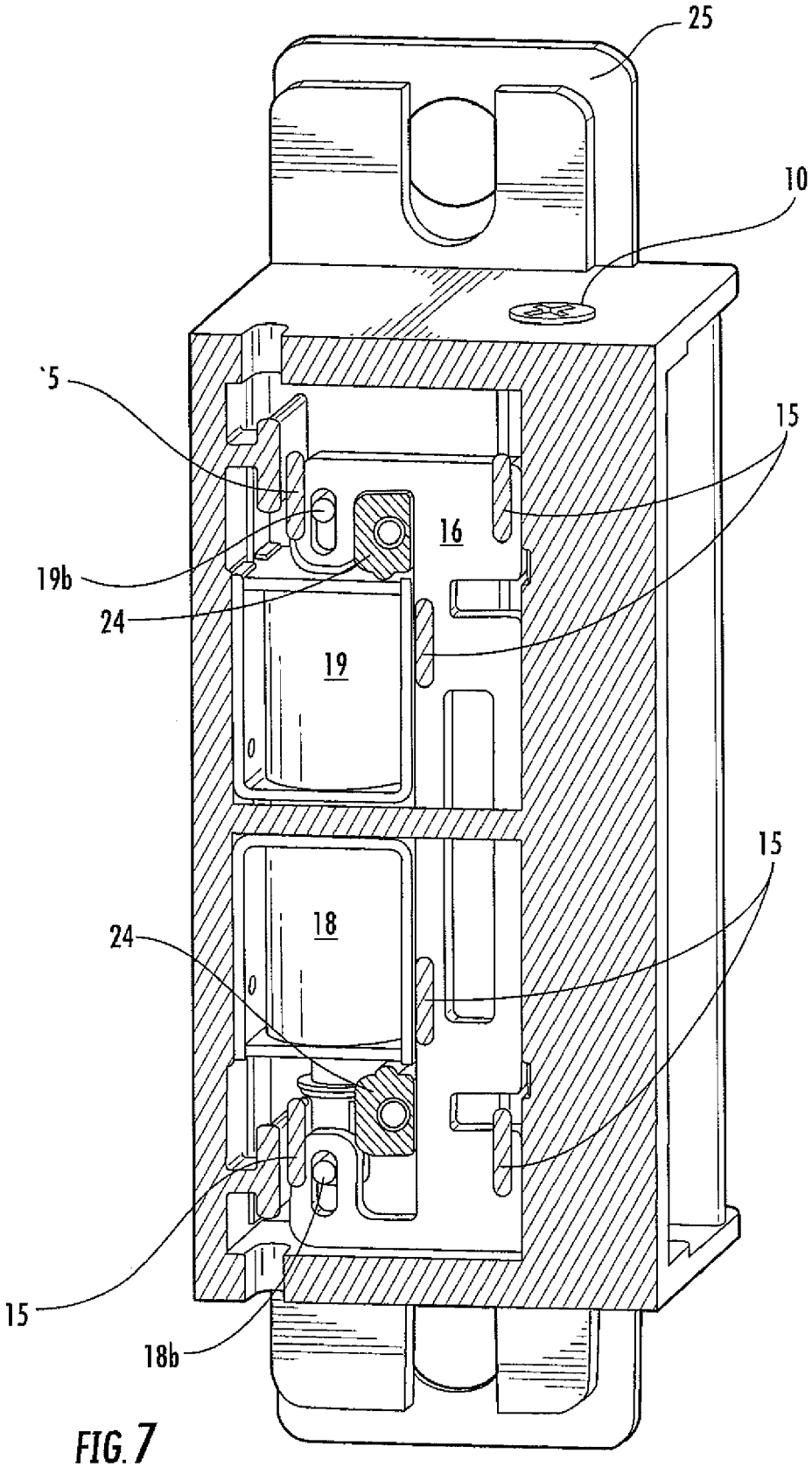
FIG. 7 is a rear section view of the strike of FIG. 1.
Figure 8:
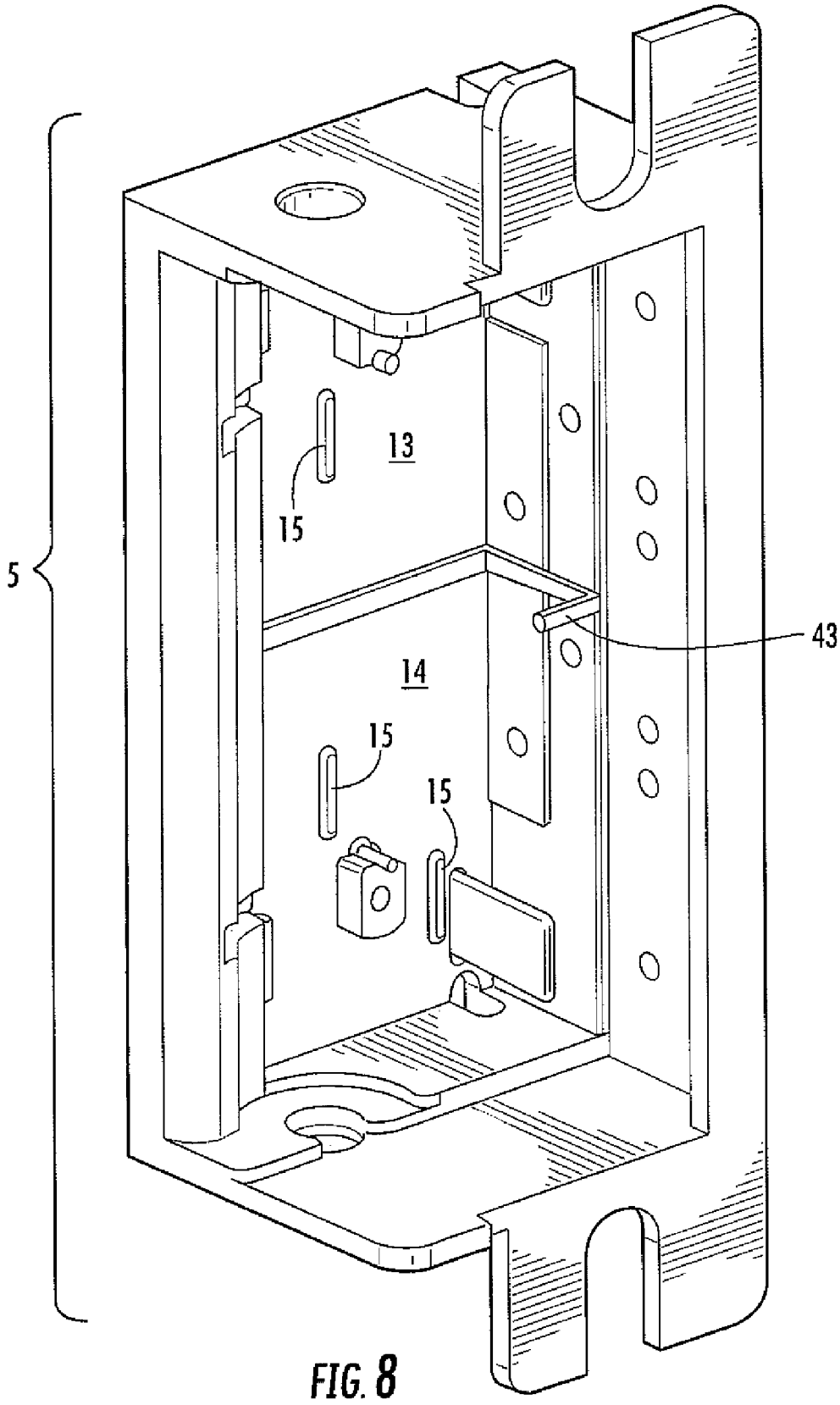
FIG. 8 is a perspective view of the strike housing of FIG. 2.
Figure 9:
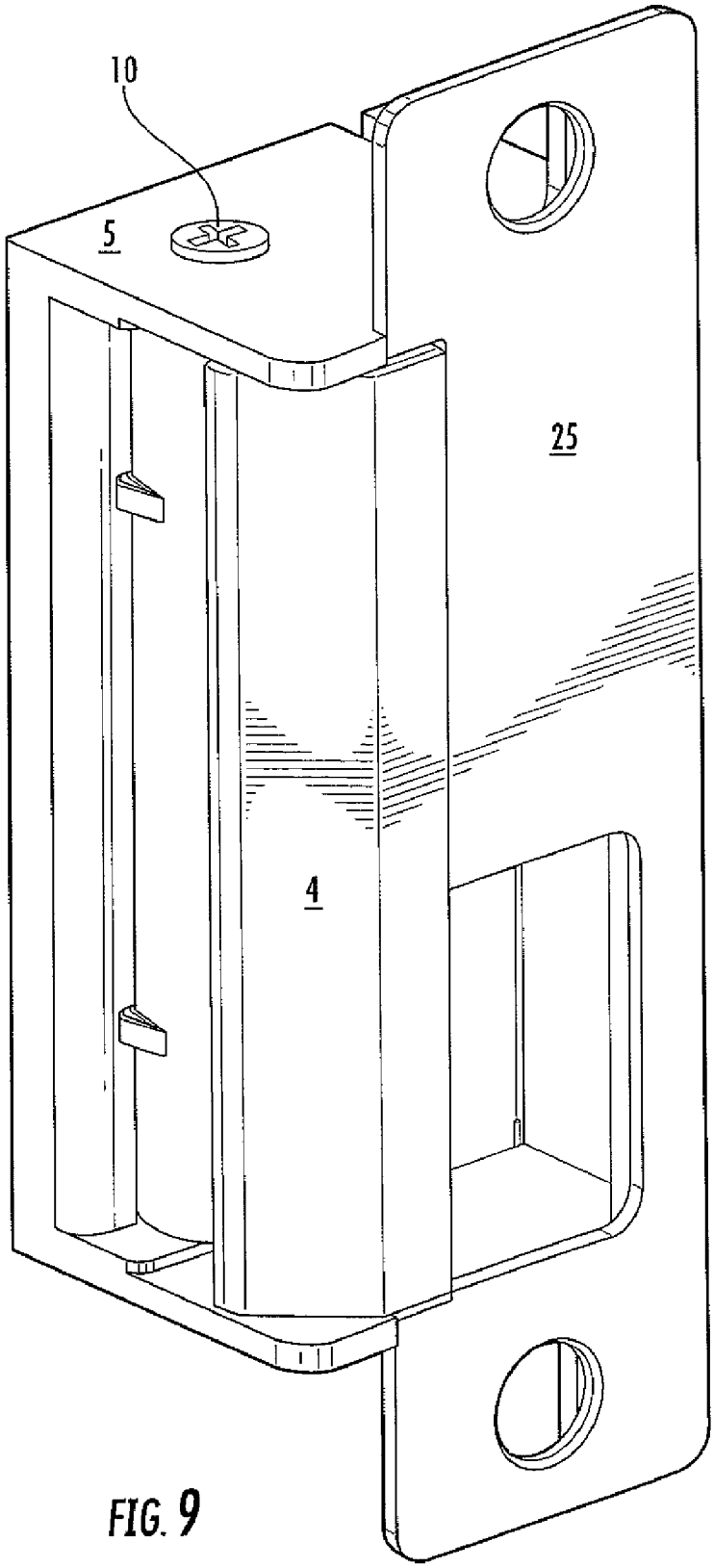
FIG. 9 is a perspective view of the strike of FIG. 1.

FIGS. 2, 6 and 8 illustrate another embodiment of the strike of the invention. Most of the elements are the same as those discussed in respect of the other drawing figures except as discussed below. Optional shims 38 and 39 can be affixed to keeper 4 with screws 40. One or both shims are used in installations where it is desirable to move the door toward the frame for a tighter fit. Trim skirt 41 is used to mask irregularities in the frame cut-out and provide a more finished look to the installation. The skirt 41 is affixed to the back of housing 5 with screws 42. A necked-in portion 46 is provided on rod 6 to give more clearance to the spring. Optional center rib 43 provides a more secure anchor for spring 44. Extension arm 45 of spring 44 extends between the housings of solenoids 18 and 19 and abuts center rib 43. This relationship is illustrated in more detail in FIG. 6 which is a perspective, partial section view from the top of the housing 5 of a partially assembled strike.

An electrically operable door strike is provided having substantially improved strength, improved security and simplified operation.

What is claimed is:

1. An electrically operable door strike, comprising:

a housing with a plurality of walls, at least one of said walls comprising ribs extending outwardly from the wall toward an interior portion of the housing;

a latch bolt keeper pivotally mounted on said housing for pivoting movement around a pivot axis from a first keeper position to a second keeper position for respectively engaging a latch and moving away from the latch, said keeper having at least one curved face spaced from said axis and substantially coaxial with said axis;

a vertically disposed locking member slidably mounted on said housing intermediate said curved face and said ribs, said locking member being a substantially flat plate having a vertical longitudinal edge, the locking member being rectilinearly vertically slidable in a plane substantially parallel with said pivot axis;

at least one locking member engaging arm extending from the curved face and engaging the longitudinal edge when the locking member is in a first locking member position or a third locking member position, the locking member thereby maintaining the latch bolt keeper in the first keeper position;

the longitudinal edge having at least one notch therein and when the locking member is moved to a second locking member position, the locking member engaging arm is permitted to move freely through the notch thereby permitting the latch bolt keeper to move to the second keeper position;

a spring acting between said keeper and said housing and urging said keeper into said first keeper position; and a first solenoid having a first shaft which extends from one end thereof when the solenoid is actuated and a first pin affixed to the first shaft, the first pin being in actuating engagement with a first slotted opening of the locking member for moving the locking member from the first locking member position to the second locking member position and a second solenoid having a second shaft which extends from one end thereof when the solenoid is actuated and a second pin affixed to the second shaft, the second pin being in actuating engagement with a second slotted opening of the locking member for moving the locking member from the third locking member position to the second locking member position, wherein the first solenoid is actuated to move the locking member when the strike is installed in a door frame of a left hand operated door and the second solenoid is activated to move the locking member when the strike is installed in a door frame of a right hand operated door.

2. The electrically operable door strike of claim 1 wherein the first solenoid and the second solenoid are mounted on the housing, one above the other and coaxial with one another, the first shaft extending in the opposite direction and away from the second shaft.

3. An electrically operable door strike, comprising:

a housing with a plurality of walls, at least one of said walls comprising ribs extending outwardly from the wall toward an interior portion of the housing;

a latch bolt keeper pivotally mounted on said housing for pivoting movement around a pivot axis from a first keeper position to a second keeper position for respectively moving away from a latch and engaging the latch, said keeper having at least one curved face spaced from said axis and substantially coaxial with said axis;

a vertically disposed locking member slidably mounted on said housing intermediate said curved face and said ribs, said locking member being a substantially flat plate having a vertical longitudinal edge, the locking member being rectilinearly vertically slidable in a plane substantially parallel with said pivot axis;

at least one locking member engaging arm extending from the curved face and engaging the longitudinal edge when the locking member is in a second locking member position, the locking member thereby maintaining the latch bolt keeper in the second keeper position;

the longitudinal edge having at least one notch therein and when the locking member is moved to a first locking member position or a third locking member position, the locking member engaging arm is permitted to move freely through the notch thereby permitting the latch bolt keeper to move to the first keeper position;

a spring acting between said keeper and said housing and urging said keeper into said second keeper position; and a first solenoid having a first shaft which extends from one end thereof when the solenoid is actuated and a first pin affixed to the first shaft, the first pin being in actuating engagement with a first slotted opening of the locking member for moving the locking member from the first locking member position to the second locking member position and a second solenoid having a second shaft which extends from one end thereof when the solenoid is actuated and a second pin affixed to the second shaft, the second pin being in actuating engagement with a second slotted opening of the locking member for moving the locking member from the third locking member position to the second locking member position, wherein the first solenoid is actuated to move the locking member when the strike is installed in a door frame of a left hand operated door and the second solenoid is activated to move the locking member when the strike is installed in a door frame of a right hand operated door.

4. The electrically operable door strike of claim 3 wherein the first solenoid and the second solenoid are mounted on the housing, one above the other and coaxial with one another, the first shaft extending in the opposite direction and away from the second shaft.

* * * * *